US008961258B2

(12) United States Patent
Bálint

(10) Patent No.: US 8,961,258 B2
(45) Date of Patent: Feb. 24, 2015

(54) INTERLOCKING BUILDING BLOCK, PAVING UNIT, TILE OR TOY ELEMENT AND THE CONSTRUCTION METHOD THEREOF

(76) Inventor: Adám Bálint, Budapest (HU)

( * ) Notice: Subject to any disclaimer, the term of this patent is extended or adjusted under 35 U.S.C. 154(b) by 55 days.

(21) Appl. No.: 13/823,844

(22) PCT Filed: Sep. 12, 2011

(86) PCT No.: PCT/HU2011/000092

§ 371 (c)(1),
(2), (4) Date: Mar. 15, 2013

(87) PCT Pub. No.: WO2012/035365

PCT Pub. Date: Mar. 22, 2012

(65) Prior Publication Data

US 2013/0178130 A1 Jul. 11, 2013

(30) Foreign Application Priority Data

Sep. 15, 2010 (HU) ..... 1000501

(51) Int. Cl.
*A63H 33/04* (2006.01)
*A63H 33/08* (2006.01)
(Continued)

(52) U.S. Cl.
CPC ..... *A63H 33/084* (2013.01); *A63H 33/065* (2013.01); *E01C 5/00* (2013.01);
(Continued)

(58) Field of Classification Search
USPC ..... 446/85, 105, 106, 108, 109, 112–115, 446/122, 124, 125, 128; 52/271, 284, 574, 52/585.1, 586.1, 588.1, 177, 604, 608, 52/592.1, 593.2
See application file for complete search history.

(56) References Cited

U.S. PATENT DOCUMENTS 1,969,729 A 8/1934 Damianik
2,708,329 A * 5/1955 McKee ..... 52/286
(Continued)

FOREIGN PATENT DOCUMENTS

| | | |
|---|---|---|
| GB | 1403590 | 8/1975 |
| RU | 2280118 | 7/2006 |
| SU | 1581802 | 7/1990 |

OTHER PUBLICATIONS

PCT International Search Report, issued Feb. 9, 2012, for PCT International Patent Application No. PCT/HU2011/000092, filed Sep. 12, 2011.

(Continued)

*Primary Examiner* — Kien Nguyen
(74) *Attorney, Agent, or Firm* — Pearl Cohen Zedek Latzer Baratz LLP

(57) ABSTRACT

An interlocking building block, and procedure for constructing the same, having a planar locking mechanism and a spatial locking mechanism. The planar locking mechanism being a three-clawed piece built around an equilateral triangle with protruding arms and grooves corresponding to a circular arc. The protruding claws are rotated on a plane around a center of rotation. These align with grooves of another three-clawed piece to offer a locking mechanism, where the center point of the circular arc is identical to the center of planar rotation. The spatial locking mechanism may have a hexagonal prism placed next to the three-clawed piece and connected to the corners of the equilateral triangle, into which the three-clawed piece is placed so that the protruding claws extend beyond the hexagonal prism, or the spatial locking mechanism consists of protrusions ensuring a groove/taper connection and connecting grooves, so that each piece contains protrusions and grooves.

17 Claims, 13 Drawing Sheets

(51) Int. Cl.

| | |
|---|---|
| ***A63H 33/06*** | (2006.01) |
| ***E01C 5/00*** | (2006.01) |
| ***E04B 1/61*** | (2006.01) |
| *E04B 2/18* | (2006.01) |

(52) U.S. Cl.

CPC ..... *A63H 33/062* (2013.01); *E04B 1/54* (2013.01); *E01C 2201/12* (2013.01); *E01C 2201/14* (2013.01); *E01C 2201/16* (2013.01); *E04F 2201/091* (2013.01); *E04F 2201/095* (2013.01)

USPC ..... 446/108; 446/122; 446/126; 52/245; 52/284

(56) References Cited

U.S. PATENT DOCUMENTS

| | | | | |
|---|---|---|---|---|
| 4,429,506 | A | 2/1984 | Henderson | |
| 5,329,737 | A * | 7/1994 | Roberts et al. | 52/245 |
| 8,286,402 | B2 * | 10/2012 | Fleishman | 52/588.1 |
| 2007/0094988 | A1 | 5/2007 | Palsson et al. | |
| 2009/0113815 | A1 | 5/2009 | Woodcock | |

OTHER PUBLICATIONS

International Preliminary Report on Patentability, issued Mar. 19, 2013, for PCT International Patent Application No. PCT/HU2011/000092, filed Sep. 12, 2011.

* cited by examiner

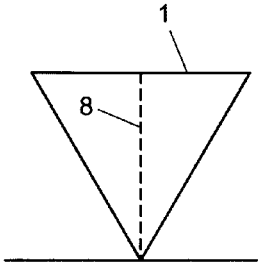
Fig.1/a
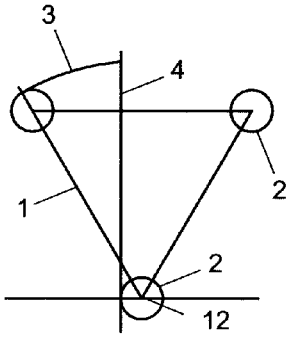
Fig.1/b
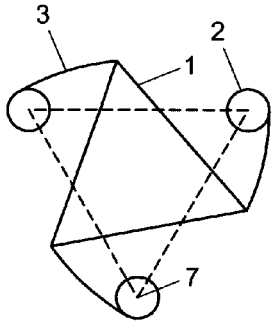
Fig.1/c
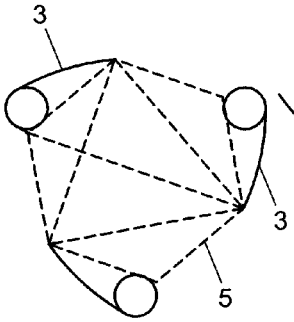
Fig.1/d
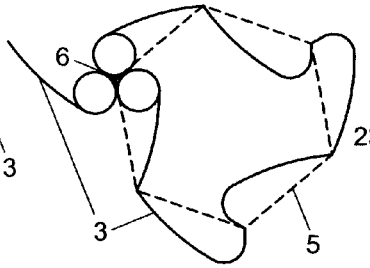
Fig.1/e
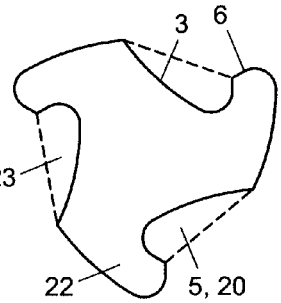
Fig.1/f
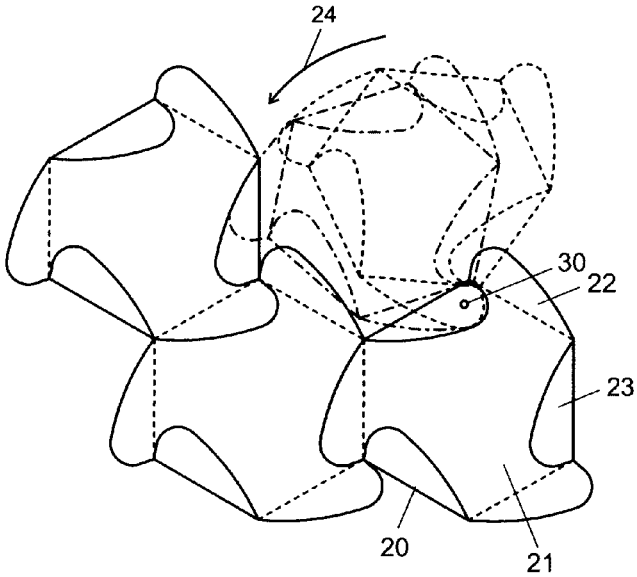
Fig.3

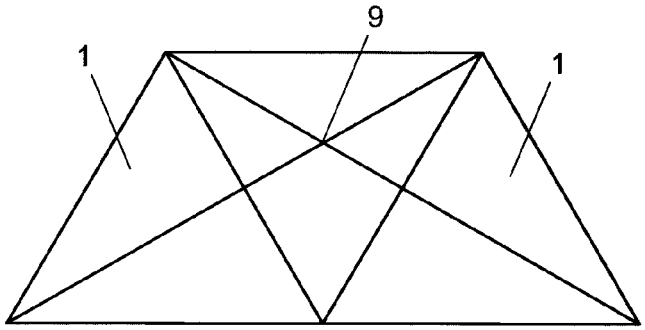
Fig.2/a
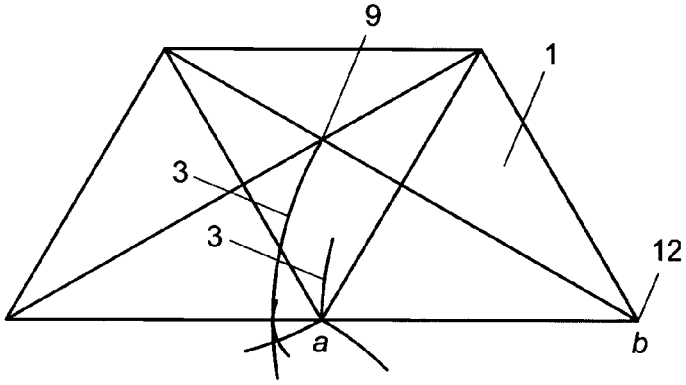
Fig.2/b
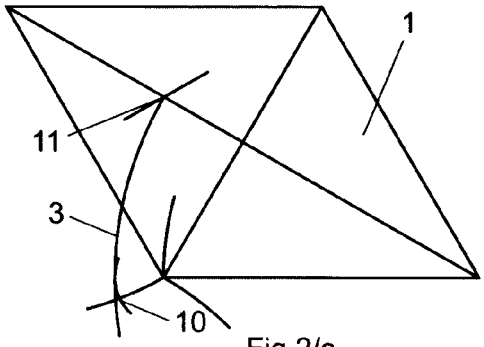
Fig.2/c
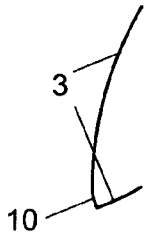
Fig.2/d
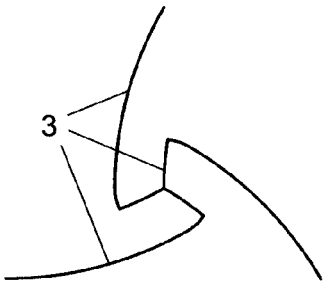
Fig.2/e
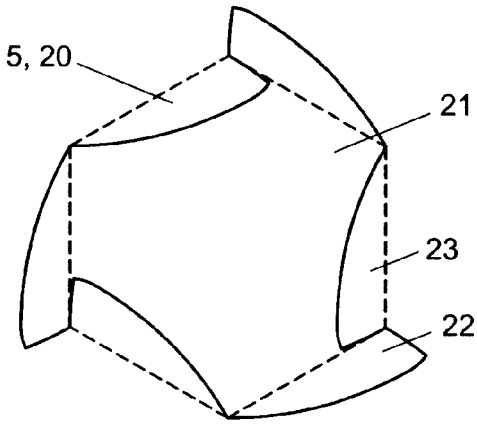
Fig.2/f

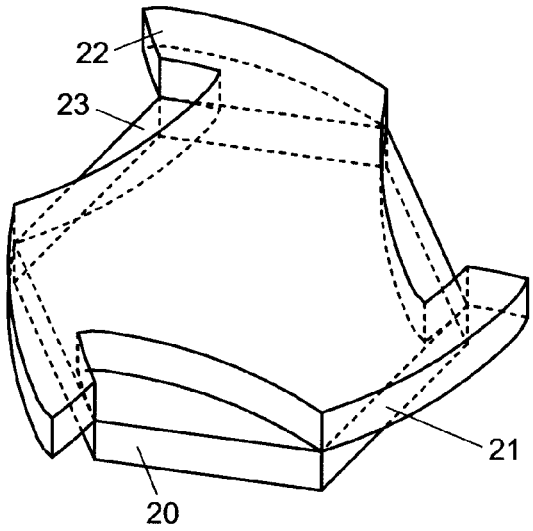
Fig.13
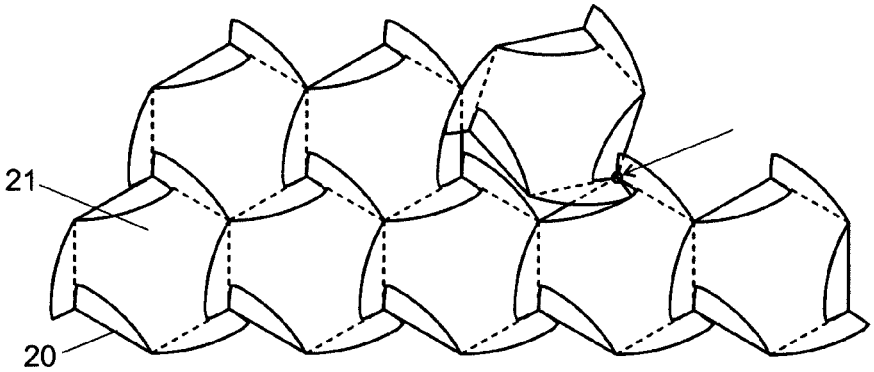
Fig.14
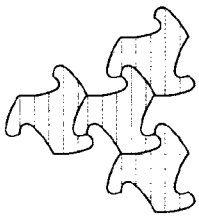
Fig.15/a
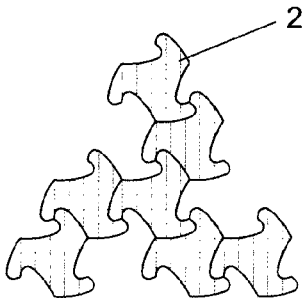
Fig.15/b
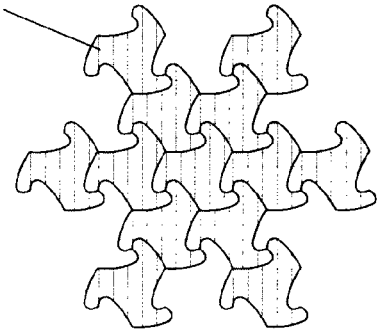
Fig.15/c

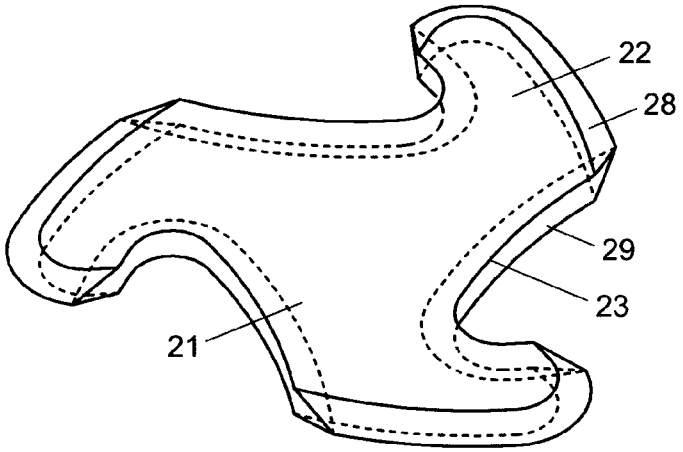
Fig.16
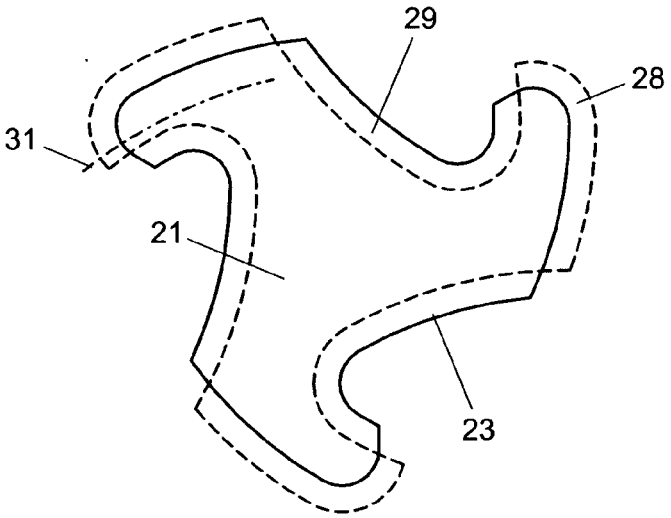
Fig.17
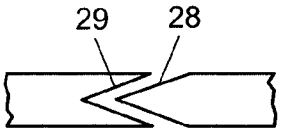
Fig.18/a
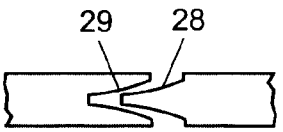
Fig.18/b
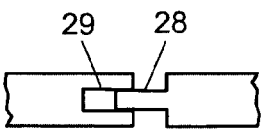
Fig.18/c
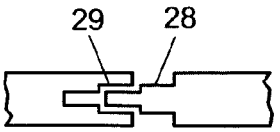
Fig.18/d
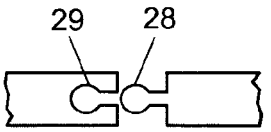
Fig.18/e

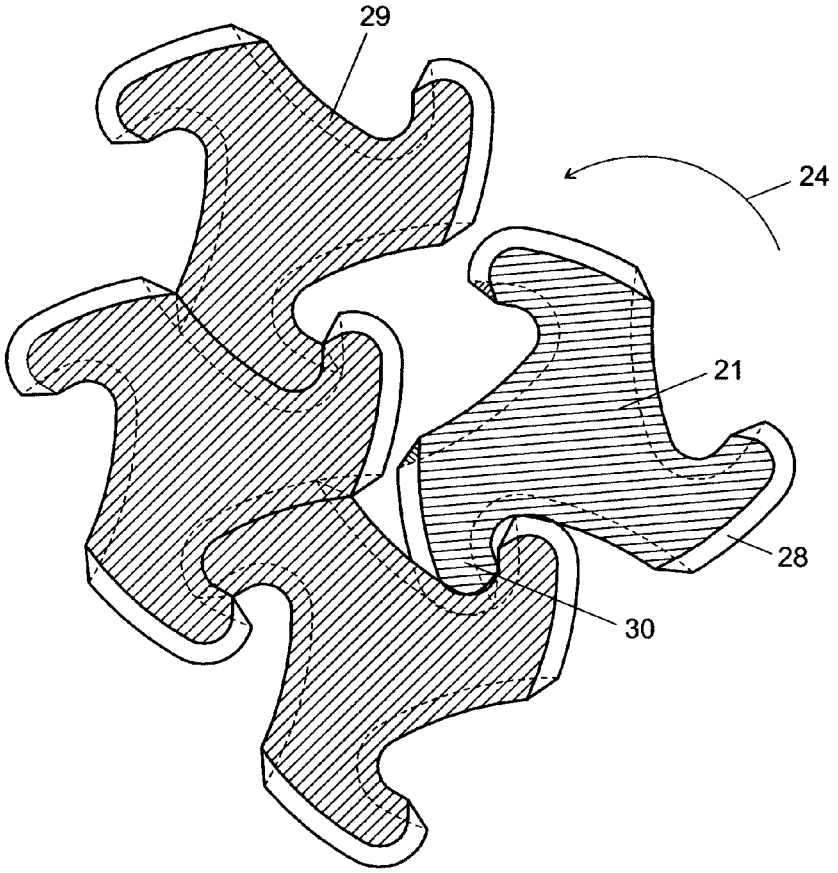
Fig.19/a
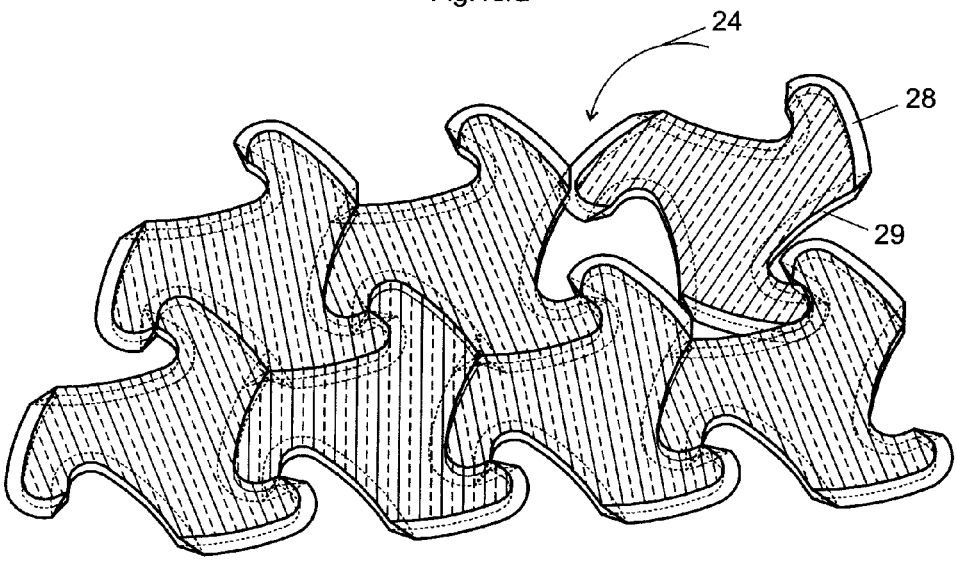
Fig.19/b

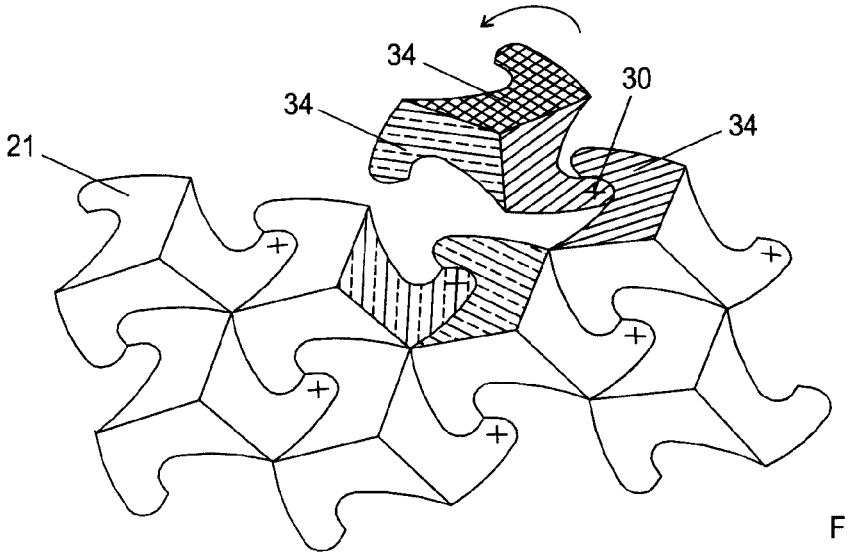
Fig.24/a
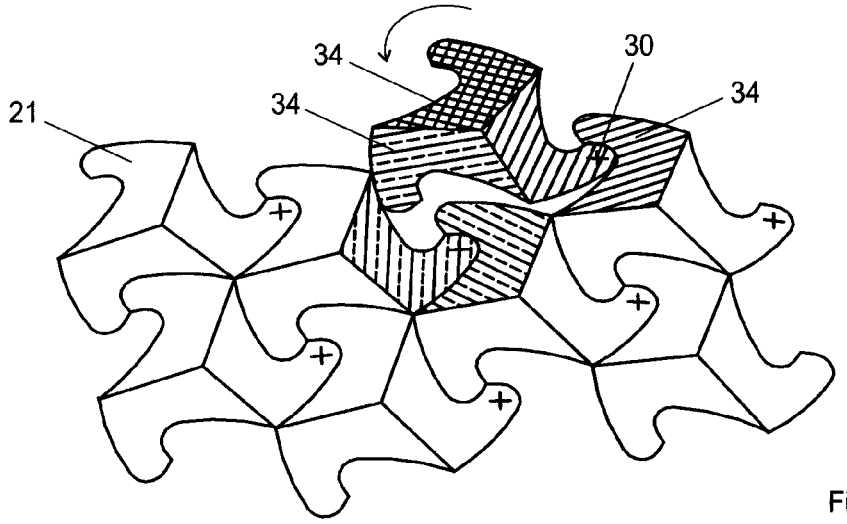
Fig.24/b
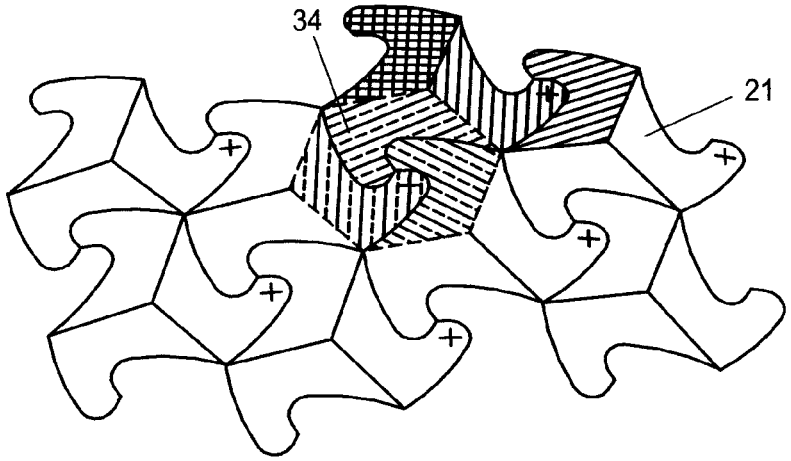
Fig.25

INTERLOCKING BUILDING BLOCK, PAVING UNIT, TILE OR TOY ELEMENT AND THE CONSTRUCTION METHOD THEREOF

CROSS-REFERENCE TO RELATED APPLICATIONS

This application is a National Phase Application of PCT International Application No. PCT/HU2011/000092, International Filing Date Sep. 12, 2011, claiming priority from Hungarian Patent Application No. P1000501, filed Sep. 15, 2010, which is hereby incorporated by reference.

BACKGROUND OF THE INVENTION

Interlocking building block, paving unit, tile or toy element primarily for the construction of structures without the use of mortar or for the purpose of ornamental covering. In addition, it may also be used to produce a planar or spatial toy/game suitable for building in patterns. The procedure describes the possible methods of implementation.

US patent 2009113815 describes a three dimensional building block. This uses a hexagonal pyramidal frustum for implementing spherical surfaces. Mounting tapers and notches are implemented on the sides of the building block in order to prevent elements from slipping. US patent 2007094988 describes flat building blocks with planar rotation that have interconnected studs, locked when the building block is rotated into the final plane of the structure. Tapers only interconnect once this is been performed.

U.S. Pat. No. 4,429,506 describes interconnected building blocks offering binding without mortar. In essence, this is a cube set on one of its edges, with mounting tapers and grooves implemented on the sides. These mounting elements do not prevent the placement of the cube in the direction of its body diagonal. When placed, the building block will no longer fall apart. It can only be removed in the direction it was placed from. The deficiency of the building blocks described in all three patents is that they can be removed by simply moving in a specific direction, and that they require special mounting tapers.

SUMMARY OF THE INVENTION

By developing the invention, our aim was to solve the task of developing a building block or cover piece which makes mortarless load bearing interconnection possible when placed that cannot be removed in any straight direction, is also capable of implementing a self-bearing structure, and may even be used to construct a curtain wall, cylinder, or dome segment. At the same time, it can also be used to produce a pleasing pattern when used as a tile. Due to the special implementation of the invention, it can also be used for designing a component used in a jigsaw type puzzle game. However, since the components of the game do not fall apart, they can also be used for building three dimensional structures. The invention also contains the production procedure of these elements.

The invention is an interlocking building block, paving unit, tile or toy element, one part of which is a piece offering at least one planar locking mechanism, and the other part of which is an element offering at least one spatial locking mechanism. The building block, paving unit, tile or toy element is characterized by the piece providing the planar locking mechanism being a three-clawed piece built around an equilateral triangle with grooves corresponding to its protruding claws arranged in a circular arc which are congruent with its boundaries. The protruding claws are rotated on a plane around a center of rotation. These align with the grooves of another three-clawed piece to offer a bayonet type locking mechanism, where the center point of the circular arc is identical to the center of planar rotation. The element providing spatial locking is either comprised of at least one hexagonal prism placed next to the three-clawed piece and connected to the corners of the equilateral triangle, into which the three-clawed piece is placed so that the protruding claws extend beyond the hexagonal prism to the same extent that the grooves extend into the base area of the hexagonal prism, or the element providing for spatial locking consists of protrusions (tapers) built at the circumference of the three-clawed piece ensuring a groove/taper connection and connecting grooves, so that each piece contains protrusions (tapers) as well as grooves.

The procedure according to the invention pertains to the implementation of building blocks, paving units, tiles or toy elements according to the invention:

Procedure for the production of a building block, paving unit, tile or toy element according to the invention, during which the boundary of a three-clawed piece providing planar locking is constructed first: Step 1: an equilateral triangle is constructed corresponding to the size of the element to be produced, and circles with identical radiuses are constructed in its corners. Step 2: from the center of a circle in one of the corners of the triangle, an arc is drawn which is tangential to the other circle. Step 3: A construction line is drawn which is an orthogonal construction line 4 tangent to the circle around the center point of the circular arc on the side of the circular arc; the point where the construction line intersects with the circular arc will be one of the end points of the circular arc, also one of the corners of the hexagon. Steps 4 and 5: this action is repeated on the other two circles, or the resulting circular arc is rotated by steps of 120 degrees. This will result in the end points of the resulting circular arc comprising an equilateral triangle. Step 6: this triangle is used for constructing the hexagon. Step 7: a line is constructed from the corner of the constructed hexagon which is tangential to the adjoining circle. This tangential line, the related arc, and the circular arc which is tangential to it will be one of the protruding claws of the three-clawed piece. Step 8: this protruding claw is rotated by steps of 120 degrees based on the polar array around the resulting corners of the hexagon. This yields one side of the grooves protruding into the base element hexagon. Step 9: this is rotated in steps of 120 degrees, resulting in the remaining sides. In order for the three-clawed piece to provide a self-locking mechanism, the ratio between the radius of the circles and the height of the equilateral triangle may be 1 to 1.3:9. Following this, a piece with arbitrary thickness is produced. This is followed by the production of an element providing spatial locking. This may be performed in two ways: either a prism is built on the hexagon constructed together with the three-clawed piece providing planar locking, or groove/taper locking protrusions and related grooves are produced on the circumference of the three-clawed piece and connected to it in a manner so that the taper is built outwards from the convex protruding claw, and the groove aligned with the taper produced in the concave depression.

A building block, paving unit, tile or toy element achieving the stated purpose can also be produced according to another procedure, during which the boundary of a three-clawed piece providing planar locking is constructed first: Step 1: three equilateral triangles are constructed corresponding to the size of the element to be produced. Step 2: the center point of the middle triangle is determined. Step 3: circular arcs are constructed intersecting the center point of the triangle and traversing point a on the corner of the middle triangle from origin b on the corner of the adjoining triangle. Step 4: the circular arc at point a is rotated by steps of 120 degrees around point a based on the polar array. Step 5: a tangent is constructed from point a to the circular arcs intersecting the center point of the triangle. Step 6: the polyline consisting of the three circular arcs is constructed. Step 7: these are rotated by steps of 120 degrees around point a based on the polar array. This yields one of the protruding tapers and the outline of one of the grooves protruding into the base. Step 8: point a is connected to the two ends of the circular arc. These yield the corners of a hexagon. Step 9: the hexagon is constructed, together with the other protruding tapers and grooves. Following this, a piece is produced with arbitrary thickness. This is followed by the building of the element providing spatial locking, which may be performed in two ways: either a prism is constructed on the hexagon constructed together with the three-clawed piece providing planar locking, or groove/taper locking protrusions and related grooves are produced on the circumference of the three-clawed piece and connected to it in a manner so that the taper is built outwards from the convex protruding claw, and the groove aligned with the taper produced in the concave depression.

BRIEF DESCRIPTION OF THE DRAWINGS

The implementations of the invention are described in the sub claim points. The invention is described in detail using drawings, where FIGS. 1 *a-f* depict the steps of one of the processes described in the invention, FIG. 2 *a-f* depict the steps of another process described in the invention, FIG. 3 depicts one of the elements described in the invention as well as how it is rotated to lock, FIG. 13 is a spatial depiction the other implementation shape of the element described in the invention produced using procedure 2, FIG. 14 is a spatial depiction of a covering that can be produced using the element depicted on FIG. 13, how the element is rotated to lock, and the rotational point, FIGS. 15 *a-c* contain examples of patterns that can be produced using the elements described in the invention, FIG. 16 is a spatial depiction of a fourth possible implementation of the building blocks described in the invention, FIG. 17 depicts the limitation of the size of the tapers and grooves on the building block according to FIG. 16, FIGS. 18 *a-e* depict other possible implementations of the taper/groove interconnection of the building block according to FIG. 16, FIGS. 19 *a-b* depict how the building block according to FIG. 16 is placed and rotated to lock.

FIGS. 24 *a-b* is an axonometric depiction of the building block according to FIG. 21 during rotation, FIG. 25 is an axonometric depiction of the building block according to FIG. 21 following rotation.

DETAILED DESCRIPTION OF THE INVENTION

Figure 4:
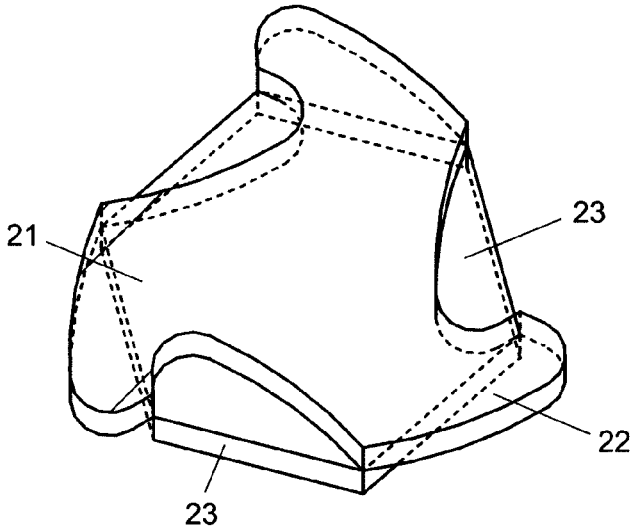
FIG. 4 is a spatial depiction of the implementation of one of the cover pieces or puzzle elements described in the invention.

FIGS. 1 *a-f* illustrate the steps of one of the processes described in the invention. This procedure serves the production of a building block, paving unit, tile or toy element according to the invention, during which the boundary of a three-clawed piece providing planar locking 21 is constructed first: Step 1: an equilateral triangle is constructed corresponding to the size of the three-clawed piece 21 to be produced (FIG. 1*a*), and circles with identical radiuses 2 are constructed in its corners. Step 2: from the center of the circle 2 in one of the corners of the triangle 1, circular arc 3 is drawn which is tangential to the other circle. Therefore, this will also be the center point 12 of the circular arc 3. Step 3: a construction line 4 is drawn which is an orthogonal construction line 4 tangent to circle 2 around the center point of the circular arc 3 on the side of the circular arc; the point where the construction line 4 which is an orthogonal construction line 4 tangent to circle 2 intersects with the circular arc 3 will be one of the end points of the circular arc, also one of the corners of the hexagon 5. Steps 4 and 5: this action is repeated on the other two circles 2, or the resulting circular arc 3 is rotated by steps of 120 degrees. This will result in the end points of the resulting circular arcs 3 comprising an equilateral triangle (FIG. 1*c*). Step 6: this triangle is used for constructing the hexagon 5. Step 7: a line 6 is constructed from the corner of the constructed hexagon 5 which is tangential to the adjoining circle (see figure). This tangential line 6, the section of the related circle 2 up to the circular arc 3, and the circular arc 3 which is tangential to it will be one of the protruding claws 22 of the three-clawed piece 21. Step 8: this protruding claw 22 is rotated by steps of 120 degrees based on the polar array around the resulting corners of the hexagon 5 (FIG. 1*e*). This yields one side of the grooves 23 protruding into the base element hexagon 5 and belonging to the three-clawed piece 21. Step nine: the remaining sides are constructed by rotating in steps of 120 degrees (FIG. 1*f*); in order for the three-clawed piece 21 to provide a self-locking connection, the radius 7 of the circles 2 may be between 11 to 14.44% of the height 8 of the equilateral triangle. A piece with opposite rotation may also be produced if, as opposed to FIG. 1*b*, the tangent line 6 is drawn on the other side. Following this, a piece with arbitrary thickness is produced. This is followed by the production of an element providing spatial locking. This may be performed in two ways: according to one solution, a hexagonal prism 20 is built on the hexagon 5 constructed together with the three-clawed piece providing planar locking 21. According to the other solution (see relevant figures later), groove/taper locking protrusions 28 (tapers) and related grooves 29 are produced on the circumference of the three-clawed piece providing planar locking 21 and connected to it in a manner so that protrusions (tapers) 28 are built outwards from the convex protruding claw, and the groove aligned with the taper 29 produced in the concave depression 23.

FIGS. 2 *a-f* depict the steps of another process described in the invention. This process also serves the production of a building block, paving unit, tile or toy element according to the invention, during which a different boundary of a three-clawed piece providing planar locking 21 is constructed first: Step 1: three equilateral triangles 1 are constructed corresponding to the size of the three-clawed piece 21 to be produced. Step 2: the center point 9 of the middle triangle 1 is determined (FIG. 2*a*). Step 3: circular arcs 3 are constructed intersecting the center point 9 of the triangle 1 and traversing point a on its corner from origin b on the corner of the adjoining triangle 1 (FIG. 2*b*). Step 4: the circular arc at point a is rotated in steps of 120 degrees around point a based on the polar array. Step 5: ten tangential circles are constructed from point a to the circular arcs 3 intersecting the center point 9 of the triangle 1 (FIG. 2*c*). Step 6: a polyline consisting of the three resulting circular arcs is constructed (FIG. 2*d*). Step 7: these are rotated by steps of 120 degrees around point a based on the polar array. This yields one of the protruding tapers 22 and the outline of one of the grooves protruding into the base 23 (FIG. 2*e*). Step 8: point a is connected to the end points 11 of the two long circular arcs 3. These yield the corners of the hexagon 5. Step 9: the hexagon, the other protruding tapers 22, and protruding grooves 23 are constructed (FIG. 2*f*). A piece with opposite rotation may also be produced if, as opposed to FIG. 2*b*, origin b is placed on the other side. Following this, a piece with arbitrary thickness is produced. This is also followed by the production of an element providing spatial locking. This may be performed in two ways: according to one solution, a hexagonal prism 20 is built on the hexagon 5 constructed together with the three-clawed piece providing planar locking 21. According to the other solution (see relevant figures later), groove/taper locking protrusions 28 (tapers) and related grooves 29 are produced on the circumference of the three-clawed piece providing planar locking 21 and connected to it in a manner so that protrusions (tapers) 28 are built outwards from the convex protruding claw, and the groove aligned with the taper 29 produced in the concave depression 23.

FIG. 3 depicts one of the elements described in the invention as well as how it is rotated to lock. The element was produced according to the procedure described first. The following is a description of this element. The circumference of the element is indicated on the figure using a continuous line, while the dashed line indicates a more remote position, and the dotted line an almost rotated position. This figure is a good illustration of how the protruding arm 22 of the three-clawed piece 21 can be rotated into groove 23 around the corner of the hexagonal prism 20 and will be in perfect alignment, while at the same time the side walls of hexagonal prism 20 also rest against each other.

Figure 5:
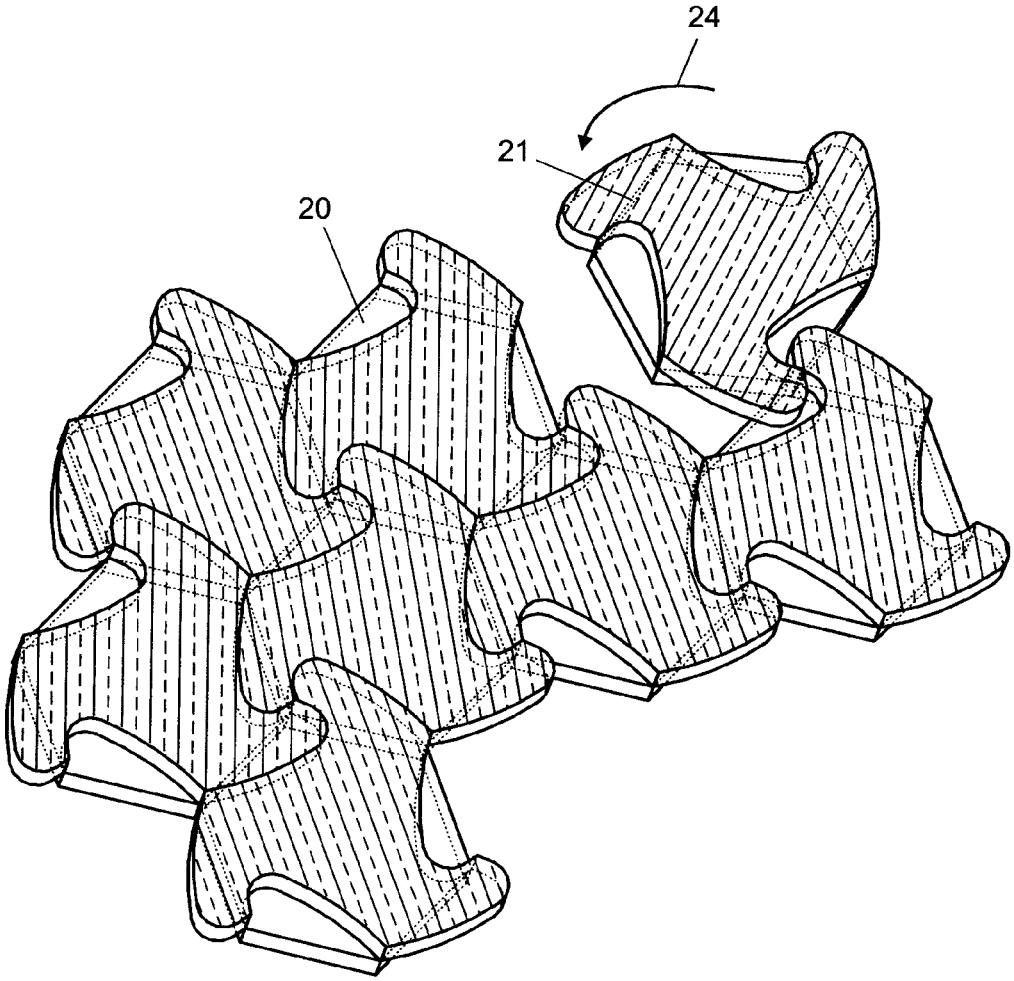
FIG. 5 is a spatial depiction of a pattern that can be produced using one of the elements described in the invention as well how the element is rotated to lock.
Figure 6:
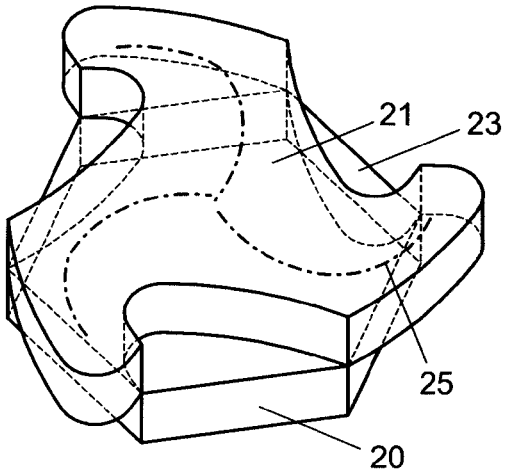
FIG. 6 is a spatial depiction of one of the building blocks described in the invention.
Figure 7:
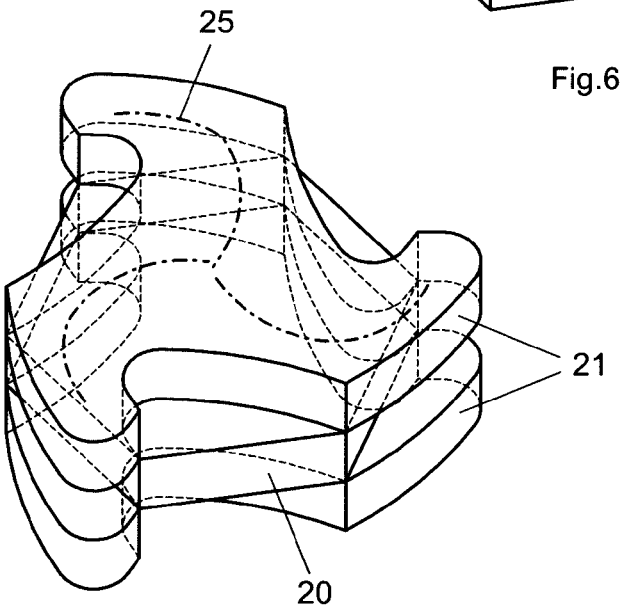
FIG. 7 is a spatial depiction of another possible implementation of the building blocks described in the invention.

FIG. 4 is a spatial depiction of how the building block, paving unit, tile or toy element described in the invention is produced. The figure contains a flat implementation which is an excellent choice either as a cover piece or for jigsaw puzzle purposes. When used as a cover piece, the preferred material of choice should be ceramics, and the three-clawed piece 21 should be coated with color so that pleasing patterns may also be produced (also see FIGS. 14 *a-c*). The material of the cover piece is homogeneous, that is the hexagonal prism 20 and the triangular piece 21 are made of the same material. Cardboard or plastic are better choices for jigsaw puzzle elements. In this case, the hexagonal prism 20 and the three-clawed piece 21 are cut out separately and glued together. It can also be produced using poured plastic. FIG. 5 is a spatial depiction of one of the shapes that can be produced using the elements described in the invention. When producing a covering, the surface is permanently locked when rotating in the specified rotational direction 24. This will not move even if subjected to forces perpendicular to the covering, even if the bedding underneath weakens. Naturally, a mirror image can also be produced, in which case the rotational direction will also be the opposite. It can also be produced using transparent or colored glass. FIG. 6 is a spatial depiction of one of the building blocks described in the invention. In this case, the only essential difference from the version described previously is the thickness. Iron reinforcement 25 is also indicated on the figure using a dashed line. This may become necessary in case of higher tension forces. FIG. 7 is a spatial depiction of a third possible implementation of the building block described in the invention, in which a hexagonal prism 20 is straddled by two three-clawed pieces 21. This implementation may facilitate a strong connection. The element produced in this manner can also be produced from one homogeneous material and may be produced using any pourable material, be that either concrete or a fired material.

Figure 8:
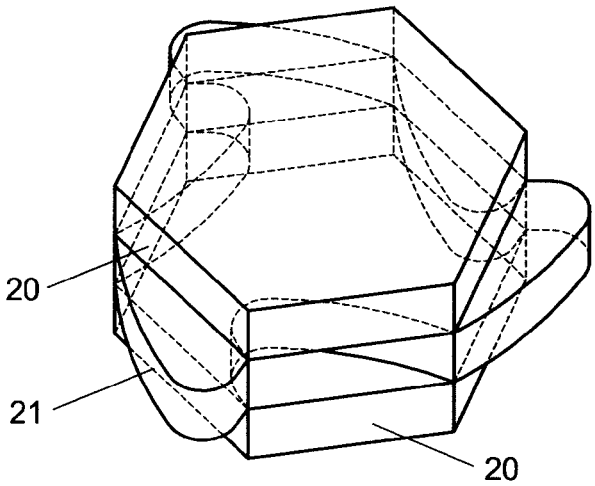
FIG. 8 is a spatial depiction of a third possible implementation of the building blocks described in the invention.
Figure 9:
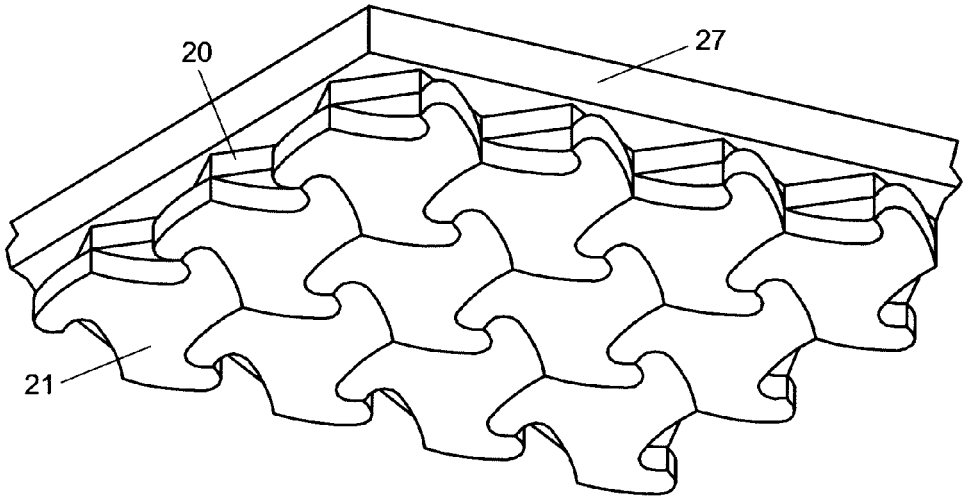
FIG. 9 is a spatial depiction a floor/ceiling or formwork that can be produced using building blocks described in the invention.
Figure 10:
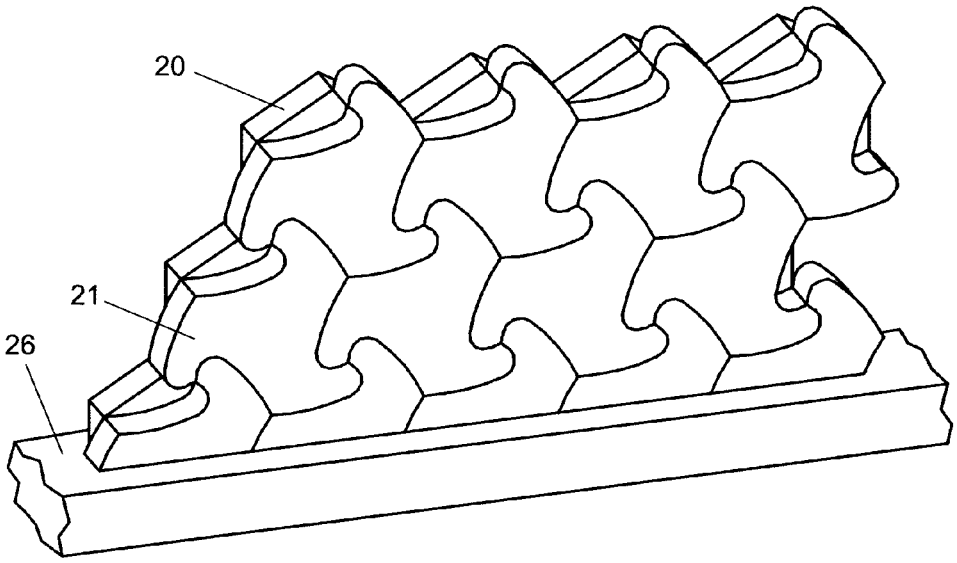
FIG. 10 is a spatial depiction of a wall that can be produced using the building blocks described in the invention.
Figure 11:
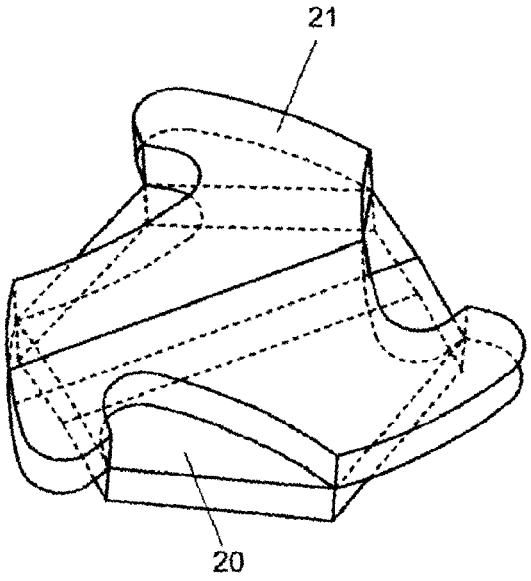
FIG. 11 is a spatial depiction of a building block described in the invention which is suitable for the production of arches and is bent at an angle.
Figure 12:
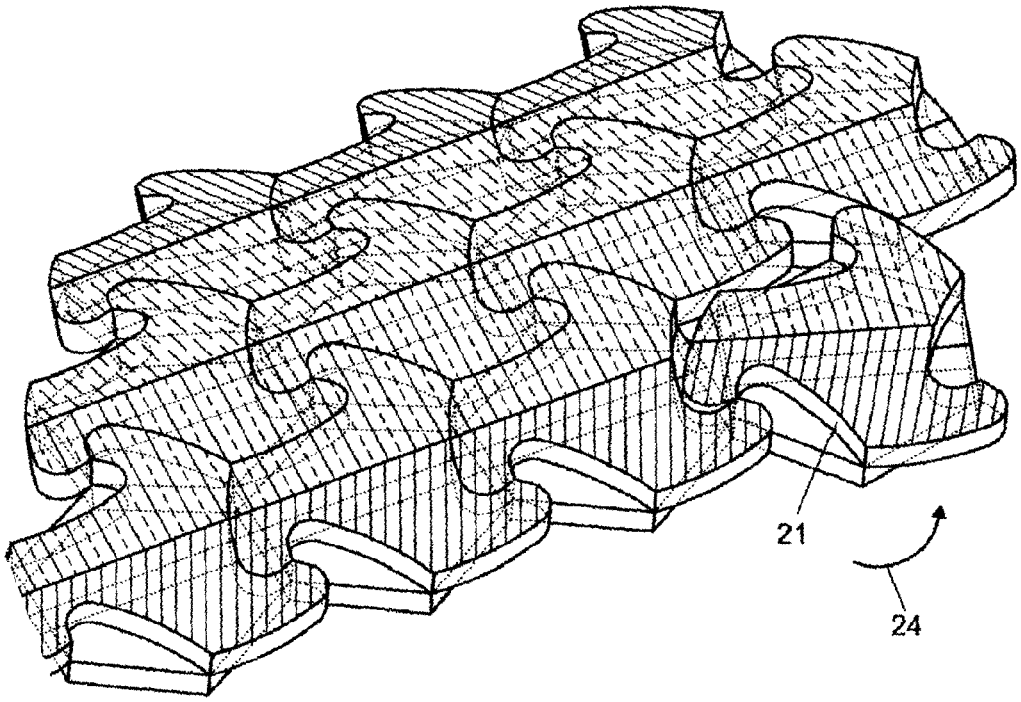
FIG. 12 is a spatial depiction of an arced wall section that can be produced using the building block bent at an angle as well as of how the element is rotated to lock.

FIG. 8 is a spatial depiction of another possible implementation of the building block described in the invention, in which two hexagonal prisms 20 straddle one three-clawed piece 21. This implementation may achieve having a hexagonal pattern on both sides. The element produced in this manner can also be produced from one homogeneous material, be that either concrete, glass, or a fired material. FIG. 9 is a spatial depiction a floor/ceiling or formwork that can be produced using building blocks described in the invention. The figure contains a flat floor/ceiling, on which another layer of concrete 27 can be applied when used as permanent formwork. FIG. 10 is a spatial depiction of a wall that can be produced using the building blocks described in the invention. The elements described in the invention were used to build a wall by placing the first row into a concrete foundation 26 created on the site. It is advised that the wall be braced using monolithic columns at the corners. Elements made of glass may also be used in the wall, without the usual ironing applied on the interconnections. FIGS. 11 and 12 are a spatial depiction of a building block described in the invention which is suitable for the production of arches and is bent at an angle, as well as the wall section that may be built using it. If the building block is broken in a desired angle along the median of the side of the hexagonal prism 20, building blocks or formwork elements result that are also suitable for the production of arced surfaces. The angle is determined by the arc to be implemented.

FIG. 13 is a spatial depiction of the other implementation shape of the element described in the invention produced using procedure 2. This implementation shape only shows a difference in the implementation at the end of the protruding taper 22 and groove 23, the arc 3 is virtually identical.

FIG. 14 depicts a covering that can be produced according to FIG. 13, while an element is being rotated to lock. An arrow indicates the center point of rotation on the figure. FIGS. 15

*a-c* contain examples of patterns that can be produced using the element described in the invention. No special explanation is required for this figure. However, it is worth noting that if the surface of the element or the material of the complete element has a different color, pattern, or granularity, arbitrary patterns can be produced using this—for example the one resulting in infinite cover according to the figures. FIG. 16 is a spatial depiction of a fourth possible implementation of the building block described in the invention. The other implementation method of the element providing spatial locking is comprised of protrusions (tapers) ensuring groove/taper interconnections implemented at the circumference of the three-clawed piece 21 as well as grooves aligned with them, so that each piece contains both protrusions (tapers) and grooves. I have come to the conclusion that the three-clawed piece 21 produced according to the construction principle described so far in the patent description is also capable of spatial locking once interlocked by rotating against each other even without the hexagonal prism 20, if protrusions 28 providing groove/taper connections are placed on the arced side edges of the protruding arms 22 of the three-clawed piece 21, and grooves 29 corresponding to the cross-section of protrusions 28 are cut into the inverse side edges of the inverted parts which provide for locking.

Figure 23:
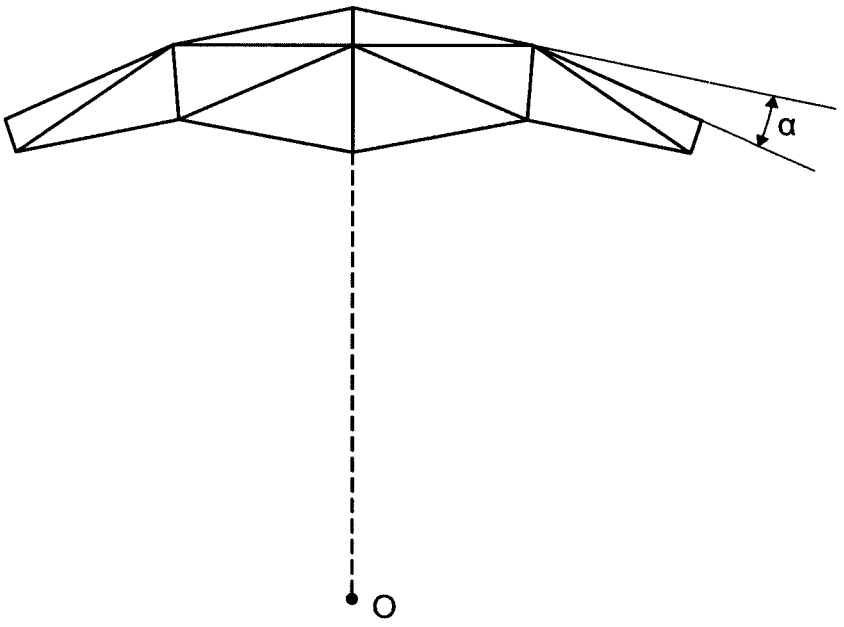
FIG. 23 depicts the relative angles of the triangles according to FIG. 22 in cross-section.

These protrusions 28 and grooves 29 ensuring spatial locking by a groove/taper connection are constructed by drawing new concentric arcs 3 around the arcs 3 of the three-clawed piece 21 as the basic element from the appropriate center points beyond the extension of the protruding arms 22 which ensure the connection and within the inverted grooves 23 (also see FIG. 23).

FIG. 17 depicts the limitation of the size of the tapers and grooves on the building block according to FIG. 16. The width and/or depth of protrusions 28 and grooves 29 ensuring locking measured from the circumferences of the three-clawed piece may vary, but may not exceed half of the relative width of the protruding arms, depicted using contour line 31. This solution may be applied irrespective of the thickness of the three-clawed piece 21.

FIGS. 18 *a-e* depict other possible implementations of taper/groove interconnection of the building block according to FIG. 16. Cross-sections of the protrusions 28 and the appropriate grooves 29 may change, but in order to ensure solidity, a triangular (see FIG. 18 *a*) or conical (see FIG. 18 *d*) cross-section is preferred at the interlocks. However, this may also be flat (see FIG. 18 *c*) or stepped (see FIG. 18 *d*). In case of a three-clawed piece 21 made of a flexible material, the groove/taper connection may also be snap fastened (see FIG. 18*e*). FIGS. 19 *a-b* depict how the building block according to FIG. 16 is interconnected and rotated to lock. The triangular or conic cross-section solution may also help tighten the elements together when they are rotated together and placed. The figure shows that when rotating to lock around the appropriate center of rotation 30, the protrusions implemented 28 do not collide, as the places indicated with thick shading 29 contain grooves.

I have furthermore come to the conclusion that is specific spatial transformations are performed on the three-clawed piece 21 implemented with protrusions 28 and grooves 29, it is possible to produce specific dome segments as a solid layer when these are rotated to lock and placed.

Figure 20:
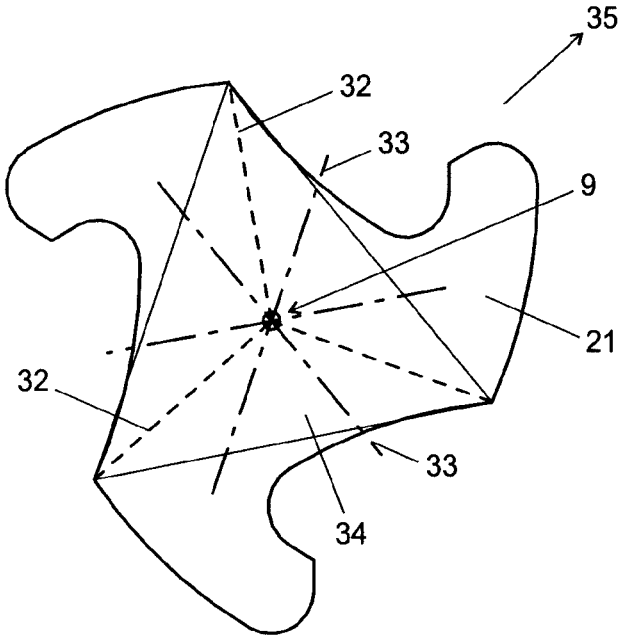
FIG. 20 is a planar depiction of the spatial building block suitable for implementing a dome segment.
Figure 21:
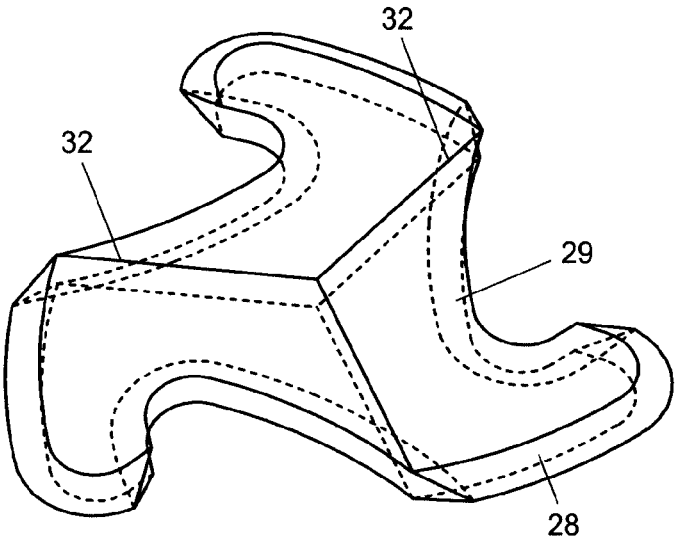
FIG. 21 is a spatial depiction of the building block according to FIG. 20.
Figure 22:
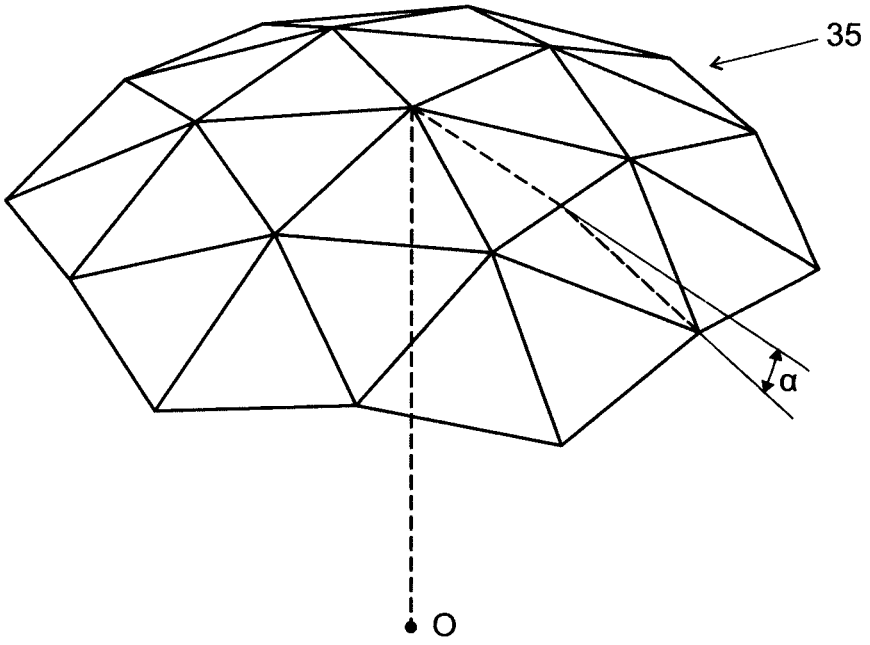
FIG. 22 is an axonometric depiction of a dome segment broken down into triangles.

FIGS. 20 and 21 depict a spatial building block suitable for producing a dome segment. In order to produce spatial building blocks of this type, it is necessary to divide the dome segment 35 cut out from the spherical surface into chords 32 the end points of which are on the spherical surface and which comprise a triangle (that may also be used to construct hexagons). The length of these chords 32 may only be different from each other to the extent that elements produced with protrusions 28 and grooves 29 will bear when rotated, and the support function of protrusions 28 and grooves 29 remain. The figure contains one such dome segment which is not based on the construction principle of the geodetic dome. A regular hexagon is placed on top of the dome. The element is constructed as follows: Determine the center 9 of the three-clawed piece 21 implemented with protrusions 28 and grooves 29, and draw chords 32 from the center 9 to launch the connecting claws, thereby breaking the three-armed claw 21 into three equal parts 34. Spatially rotate (lift out) the divided parts 34 one by one along the lines 33 intersecting the center point 9 and perpendicular to the chords 32 at a desired angle resulting from the size of the dome segment and the three-clawed piece 21. The resulting element can be used to place a solid dome segment, as joints and grooves have a certain amount of tolerance when rotated into each other. This means that it is not necessary to completely and exactly close the elements together when placed in alignment with the circumference of the basic element. When compared to the side of the regular hexagon placed at the top of the dome, the lengths of chords only deviate to an extent of approximately seven percent even when a larger dome is built. If the irregular triangle comprised of the chords 32 is projected to the plane and these elements are placed on the triangles, it can be seen that the elements are also capable of bearing the load of inaccurate joints, and protrusions that are larger in size 28 from the circumferences are able to provide support. This requires that the size of the protrusions 28 be appropriate. Hexagons may be constructed using the irregular (not equilateral) triangles comprised by the chords, the planes of which, when compared to each other, also make up angles that are approximately similar depending on the number of elements.

FIGS. 24 *a-b* depict the building block according to FIGS. 20-23 during rotation and following rotation. The rotation of spatial building blocks produced from the three-clawed piece 21 in unobstructed, as their rotation is performed around a point of rotation 30 which is in a specific plane when the two other elements are connected. When rotated, the connecting arm only connects to a plane next to it. The third arm is in another plane to which a next element will connect. The irregular hexagon created after the elements are rotated into each other and the joints and grooves slide into each other with be an irregular hexagonal element of the dome segment.

Figure 26:
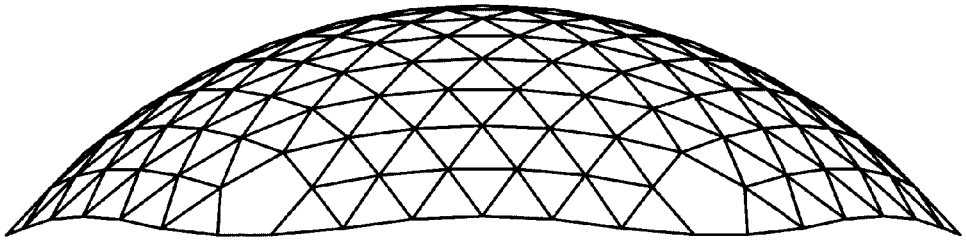
FIG. 26 is a side view depiction of the dome segment implemented using the building block according to FIG. 20.
Figure 27:
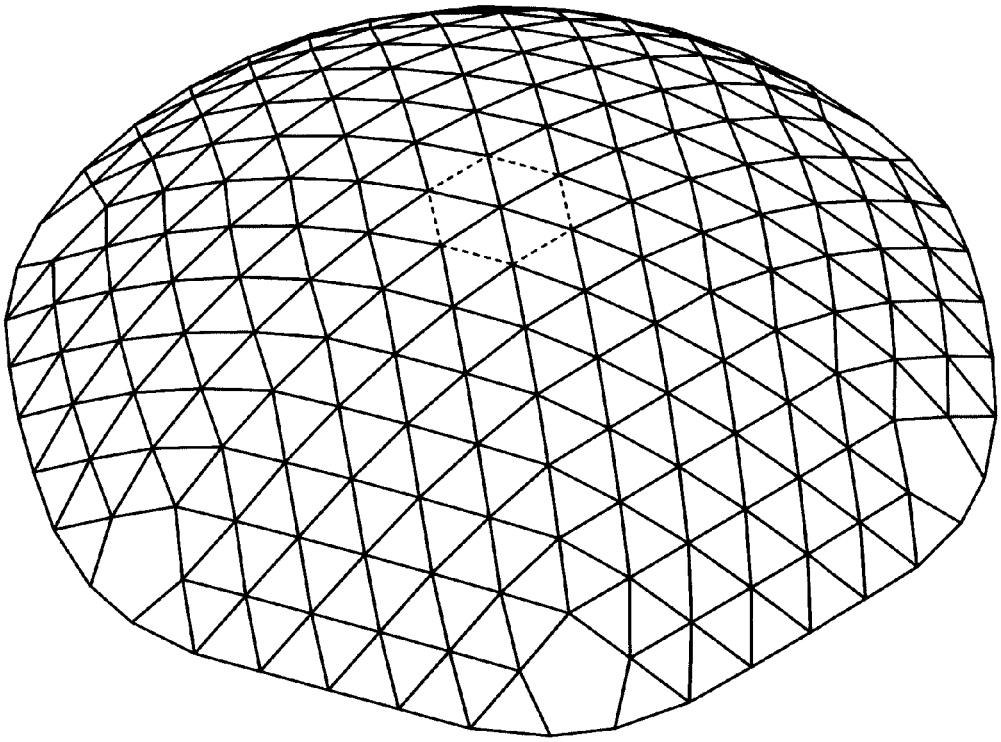
FIG. 27 is a spatial depiction of the dome segment implemented using the building block according to FIG. 20.

FIGS. 26 and 27 depict a not completely regular spherical segment that can be constructed using spatial building blocks, with openings developing at the edges. Method of joining planar building blocks: the first hexagonal pyramid 20 is standing on its corner. Following this, elements are rotated into each other by rows. The interlocking building block, paving unit, tile or toy element described in the invention is primarily suitable for the construction of structures without the use of mortar or ornamental covering. In addition, it may also be used to produce a planar or spatial jigsaw puzzle suitable for building in patterns. It is also suitable of covering outdoor surfaces as tiles, and it can be used as a component for building walls in order to quickly construct the walls of buildings. When produced using an insulation material, it is also suitable for the retrospective insulation of walls. It can also be produced as ornamental tiles for walls, floors/ceilings, and can also be used to produce formwork, outdoor floor tiles, indoor wall tiles, support walls, fences, or partition walls. Its pattern of placement makes quick construction possible. The choice of material is free; it can be poured, pressed, milled, and may even be a transparent material. It can be used as a blade wall or even a curtain wall. The spatial building block can be used during the construction of barrel vaults, chimneys, tunnels, wells, etc., that is for constructing cylindrical and semi cylindrical forms, as well as dome segments of a specific size.

LIST OF REFERENCE SIGNS

1. triangle
2. circle
3. circular segment, arc
4. construction line perpendicular to the tangent
5. hexagon
6. tangential line
7. radius
8. height
9. center point of triangle
10. tangential circle
11. end point
12. center point of circular segment
a. point
b. origin
20. hexagonal prism
21. three-clawed piece
22. protruding claw
23. groove
24. rotational direction
25. iron reinforcement
26. concrete foundation
27. concrete layer
28. protrusion
29. groove
30. center point of rotation
31. contour line
32. chord
33. line
34. sub-element
35. dome segment

The invention claimed is:

1. Interlocking building block, paving unit, tile or toy element, comprising:

at least one planar locking mechanism and at least one spatial locking mechanism, wherein the planar locking mechanism is a three-clawed piece built around an equilateral triangle with protruding claws and having grooves corresponding to the circumference of the three-clawed piece arranged in an arc, wherein the protruding claws are rotated on a plane around a center of rotation and align with the grooves of a second three-clawed piece, thereby offering a bayonet type locking mechanism, where the center point of the arc is identical to the center of planar rotation;

wherein the spatial locking mechanism is comprised of either:

at least one hexagonal prism placed next to the three-clawed piece and connected to the corners of the equilateral triangle into which the three-clawed piece is placed so that the protruding claws extend beyond the hexagonal prism to the same extent that the grooves extend into the base area of the hexagonal prism, or the spatial locking mechanism built at the circumference of the three-clawed piece comprises protrusions ensuring a groove/taper connection and connecting grooves, so that each piece contains protrusions as well as connecting grooves.

2. The building block, paving unit, tile or toy element according to claim 1, wherein the three-clawed piece and the hexagonal prism are made of a single material that may be poured, pressed, cut, or milled.

3. The building block, paving unit, tile or toy element according to claim 1, wherein the hexagonal prism is positioned between two three-clawed pieces.

4. The building block, paving unit, tile or toy element according to claim 1, wherein the three-clawed piece is positioned between two hexagonal prisms.

5. The building block, paving unit, tile or toy element according to claim 1, wherein the surface of the three-clawed piece and/or hexagonal prism is colored or gritted.

6. The building block, paving unit, tile or toy element according to claim 1, having been produced in a manner so that the three-clawed piece and the hexagonal prism are broken according to a desired angle along the medians of the surface of the hexagonal prism.

7. The building block, paving unit, tile or toy element according to claim 1, wherein said building block, paving unit, tile or toy element can be used to construct a wall by placing a first row of said element into a concrete foundation according to a freely chosen pattern.

8. The building block, paving unit, tile or toy element according to claim 1 wherein the three-clawed piece is reinforced with iron.

9. The building block, paving unit, tile or toy element according to claim 1, wherein the protrusions providing a groove/taper connection of the three-clawed piece as well as the connecting grooves have a triangular or decreasing arc cross-section.

10. The building block, paving unit, tile or toy element according to claim 1, wherein the protrusions providing a groove/taper connection of the three-clawed piece as well as the connecting grooves have a rectangular or stepped implementation.

11. The building block, paving unit, tile or toy element according to claim 1, wherein the protrusions providing a groove/taper connection of the three-clawed piece as well as the connecting grooves have a cross-section that may be snap fastened.

12. The building block, paving unit, tile or toy element according to claim 1, wherein the plane of the three-clawed piece is broken along the chords running to the center point of the triangle connecting starting points of the arcs of the three-clawed piece and the center point of the triangle lifted out to a sufficient extent, and thereby a three-clawed piece is implemented which comprises three sub-elements on various planes.

13. The building block, paving unit, tile or toy element according to claim 12, wherein a dome segment is implemented using the three-planed, three-clawed piece.

14. A method for producing a building block, paving unit, tile or toy element comprising first constructing the circumference of a three-clawed piece providing planar locking:

constructing an equilateral triangle corresponding to the size of the element to be produced, and constructing circles with identical radiuses at the corners of the triangle;

from the center of a circle in one of the corners of the triangle, drawing a circular arc which is tangential to the other circle, being also the center point of the circular arc;

drawing a construction line which is an orthogonal construction line tangent to the circle around the center point of the circular arc on the side of the circular arc, such that the point where the construction line intersects with the circular arc will be one of the end points of the circular arc and also one of the corners of a hexagon;

repeating steps 1-3 on the other two circles, or the resulting circular arc is rotated by steps of 120 degrees, thereby resulting in the end points of the resulting circular arcs comprising an equilateral triangle;

using said equilateral triangle for constructing the hexagon;

constructing a line from the corner of the constructed hexagon which is tangential to the adjoining circle, such that tangential line, the related circular arc, and the circular arc which is tangential to it will be one of the protruding claws of the three-clawed piece;

rotating the protruding claw by steps of 120 degrees based on the polar array around the resulting corners of the hexagon, such that one side of the grooves of the three-clawed piece protrudes into the hexagon;

further rotating the protruding claw in steps of 120 degrees, resulting in the remaining sides of the three-clawed piece protruding into the hexagon, whereby, in order for the three-clawed piece to provide a self-locking mechanism, the ratio between the radius of the circles and the height of the equilateral triangle may be 1 to 1.3:9;

producing a piece with arbitrary thickness from the three-clawed piece; and producing an element providing spatial locking, either by constructing a hexagonal prism on the hexagon together with the three-clawed piece providing planar locking, or producing groove/taper locking protrusions and related grooves on the circumference of the three-clawed piece and connected to it in a manner so that tapers are built outwards from the convex protruding claw, and the groove aligned with them produced in the concave depression.

15. The process according to claim 14, wherein the three-clawed piece is divided into chords the end points of which are on a spherical surface and comprise triangles by first determining the center point of the three-clawed piece constructed with protrusions and grooves, chords being drawn from the center point to the starting point of the protruding arms, thereby dividing the three-clawed piece into three equal parts, which parts are spatially rotated along the lines perpendicular to the chords intersecting the center point according to a desired angle (a) resulting from the size of the dome segment and the three-clawed piece.

16. A process for producing a building block, paving unit, tile or toy element comprising first constructing the circumference of a three-clawed piece providing planar locking:

constructing three equilateral triangles corresponding to the size of the element to be produced;

determining the center point of the middle triangle;

constructing a circular arc intersecting the center point of the triangle and traversing point (a) on the corner of a middle triangle from origin (b) on the corner of an adjoining triangle;

rotating the circular arc at point (a) on the corner in steps of 120 degrees around this point (a) based on the polar array;

constructing a tangential circle from point (a) on the corner of the middle triangle to the circular arc intersecting the center point of the triangle;

constructing the polyline consisting of the three circular segments;

rotating the three circular arcs by steps of 120 degrees around point (a) on the corner of the middle triangle based on the polar array, so as to yield one of the protruding tapers and the outline of one of the grooves protruding into the base;

connecting point (a) on the corner of the middle triangle to the two ends of the circular arc to yield the corners of a hexagon;

constructing the hexagon, together with the other protruding tapers and grooves;

producing a three-clawed piece with arbitrary thickness from the resulting piece; and building of the element providing spatial locking, by either constructing a prism on the hexagon together with the three-clawed piece providing planar locking, or producing groove/taper locking protrusions and related grooves on the circumference of the three-clawed piece and connected to it in a manner so that tapers are built outwards from the convex protruding claw, and the groove aligned with the tapers produced in the concave depression.

17. The process according to claim 16, wherein the three-clawed piece is divided into chords the end points of which are on a spherical surface and comprise triangles by first determining the center point of the three-clawed piece constructed with protrusions and grooves, chords being drawn from the center point to the starting point of the protruding arms, thereby dividing the three-clawed piece into three equal parts, which parts are spatially rotated along the lines perpendicular to the chords intersecting the center point according to a desired angle resulting from the size of the dome segment and the three-clawed piece.

* * * * *